US006932011B2

(12) United States Patent
Nagata et al.

(10) Patent No.: US 6,932,011 B2
(45) Date of Patent: Aug. 23, 2005

(54) REAR GRIP APPARATUS FOR A PERSONAL WATERCRAFT

(75) Inventors: Tadaaki Nagata, Saitama (JP); Akira Omae, Saitama (JP); Yoshikazu Ichihara, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 58 days.

(21) Appl. No.: 10/659,719

(22) Filed: Sep. 10, 2003

(65) Prior Publication Data

US 2004/0074429 A1 Apr. 22, 2004

(30) Foreign Application Priority Data

Sep. 10, 2002 (JP) ..... 2002-264610

(51) Int. Cl.[7] ..... B63B 35/73
(52) U.S. Cl. ..... 114/55.57; 114/362
(58) Field of Search ..... 114/55.5, 55.57, 114/55.52, 362; 441/69; 16/110.1, 111.1, 430

(56) References Cited

U.S. PATENT DOCUMENTS 3,304,903 A * 2/1967 Emery, Jr. ..... 441/69
RE34,922 E * 5/1995 Hattori et al. ..... 114/362
5,537,948 A * 7/1996 Kobayashi ..... 114/55.57
5,579,556 A * 12/1996 Chung ..... 16/110.1

FOREIGN PATENT DOCUMENTS

JP 09281132 A 10/1997

* cited by examiner

*Primary Examiner*—Sherman Basinger
(74) *Attorney, Agent, or Firm*—Carrier Blackman & Associates, P.C.; William D. Blackman; Joseph P. Carrier

(57) ABSTRACT

A two-piece rear grip apparatus 22 for a personal watercraft includes a body member 23 having either a U-shaped or an H-shaped cross-sectional shape. The body member includes a recessed portion 28, which opens upwardly. The apparatus also includes a grip face member 24 for placement covering the sculpted recess. The two component parts of the apparatus may be formed from a plastic resin. The grip face member 24 may be injection molded, and has slip-resistant textured irregularities 36 formed thereon to provide purchase for the palm of a user's hand. The two component parts of the apparatus may be formed by compression molding or injection molding. Even if the surface of the grip face member includes fine detail work, injection molding can effectively transfer such detail from a metal mold into the finished part. Accordingly, the grip face member can be made to include fine detail work.

21 Claims, 6 Drawing Sheets

REAR GRIP APPARATUS FOR A PERSONAL WATERCRAFT

CROSS-REFERENCE TO RELATED APPLICATIONS

The present application claims priority under 35 U.S.C. 119, based on Japanese patent application No. 2002-264610, filed Sep. 10, 2002.

BACKGROUND OF THE INVENTION

1. Field of the Invention

The present invention relates to a rear grip apparatus for a personal watercraft. More particularly, the present invention relates to a two-piece rear grip apparatus for a personal watercraft that allows a passenger, seated in the rear of the watercraft, to hold securely to the watercraft during movement thereof.

2. Description of the Background Art

A personal watercraft is known as a small size craft that is constructed and arranged to glide on the surface of a sea or lake. Many jet skis and other different types of personal watercraft are known and are commercially available. One example of a personal watercraft is described in Japanese Laid-Open Patent No. Hei 9-281132. A limited number of rear grips for personal watercraft are known and commercially available.

According to a conventional rear grip apparatus for a personal watercraft, the entire rear grip is formed as a unitary member, such as the rear grip apparatus described in Japanese Patent Laid-open No. Hei 9-281132 (page 4, FIG. 8).

FIG. 8 is a schematic view of a conventional prior art grab bar for a small watercraft, and is a copy of FIG. 8 of Japanese Patent Laid-open No. Hei 9-281132.

The conventional grab bar 50 of FIG. 8 is disposed on a rear seat, and may grasped by a passenger seated on the rear seat.

The conventional grab bar 50 is integrally formed from a single material, and may be made from die-cast aluminum, from an aluminum alloy, or from a cast resin.

The conventional grab bar 50 includes an outer side wall 50*a* and an inner side wall 50*b*, formed integrally with the outer side wall 50*a*, such that it extends in a downwardly bent configuration from an upper end of the outer side wall 50*a*.

Although the prior art grab bars are useful for their intended purposes, a need still exists for an improved rear grip apparatus for a personal watercraft. In particular, there is a need for an improved rear grip apparatus which allows fine detail work to be cast into part of the apparatus, and which can be efficiently manufactured, to reduce the production cost.

SUMMARY OF THE INVENTION

In order to achieve the object described above, in a first embodiment of the invention, a rear grip apparatus is provided for a personal watercraft, wherein a seat is placed on a deck of the watercraft, and wherein a rear grip, which can be grasped by a passenger, is disposed rearwardly of the seat. The grip apparatus according to the first embodiment hereof includes a body member having a U-shaped or an H-shaped cross-sectional shape, and including a sculpted recessed portion opening upwardly.

The grip apparatus according to the invention also includes a grip face member which is a separate piece from the body member, and which is removable therefrom. In the first embodiment, the grip face member is provided in the form of a cover for installation on the sculpted recess from above. Also in this first embodiment, the body member and the grip face member are formed from a resin, or a castable plastic material.

The rear grip is formed in a two-piece configuration, as noted, including a body member and a grip face member. As a result, the body member and the grip face member can be formed by a molding method other than blow molding, such as, for example, compression molding or injection molding. Accordingly, the rear grip apparatus according to the invention can be made at a reduced production cost.

According to a second embodiment of the invention, the rear grip apparatus for a personal watercraft includes a grip face member which is an injection molded plastic article, having non-slip textured irregularities formed at a portion thereof which is provided to be contacted by the palm of a user's hand.

Even if the non-slip textured irregularities formed on the rear grip apparatus include fine detail work, such fine detail configuration can be accurately and reproducibly transferred from the mold surface of a metal mold under pressure during injection molding. Accordingly, desired fine detail work can be effectively applied to the grip face member.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE INVENTION

Figure 1:
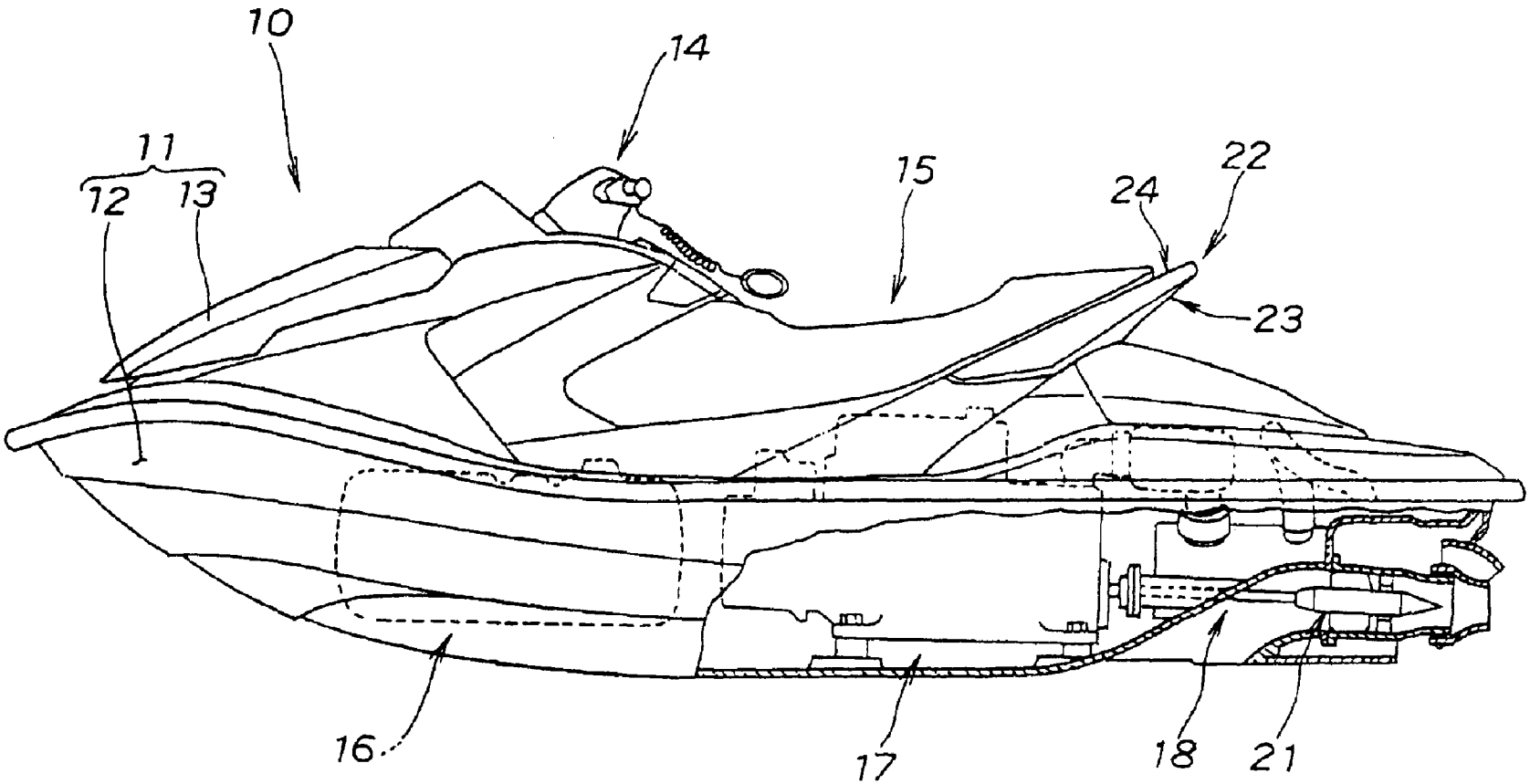
FIG. 1 is a side elevational view of a personal watercraft, which employs a rear grip apparatus according to a selected illustrative embodiment of the present invention.

FIG. 1 is a side elevational view of a personal watercraft, which includes a rear grip apparatus according to a selected illustrative embodiment of the present invention. The personal watercraft 10 includes a craft body 11 formed from a hull 12 and a deck 13 joined above the hull 12. The personal watercraft 10 also includes a steering handle member 14 disposed at a substantially central position of the deck 13, a seat 15 provided rearwardly of the steering handle member 14 on the deck 13, and a fuel tank 16.

The watercraft 10 is powered by an engine 17 attached to the center of the hull 12, with an impeller 21 attached to the engine 17 through a drive shaft 18.

The watercraft 10 also includes a rear grip apparatus 22 disposed rearwardly of the seat 15, to provide a secure handle for a rear passenger to hold while the watercraft is in motion.

The rear grip apparatus 22 includes a body member 23 for securing to an upper surface of the deck 13, and a grip face member 24 for attaching to the body member 23.

Figure 2:
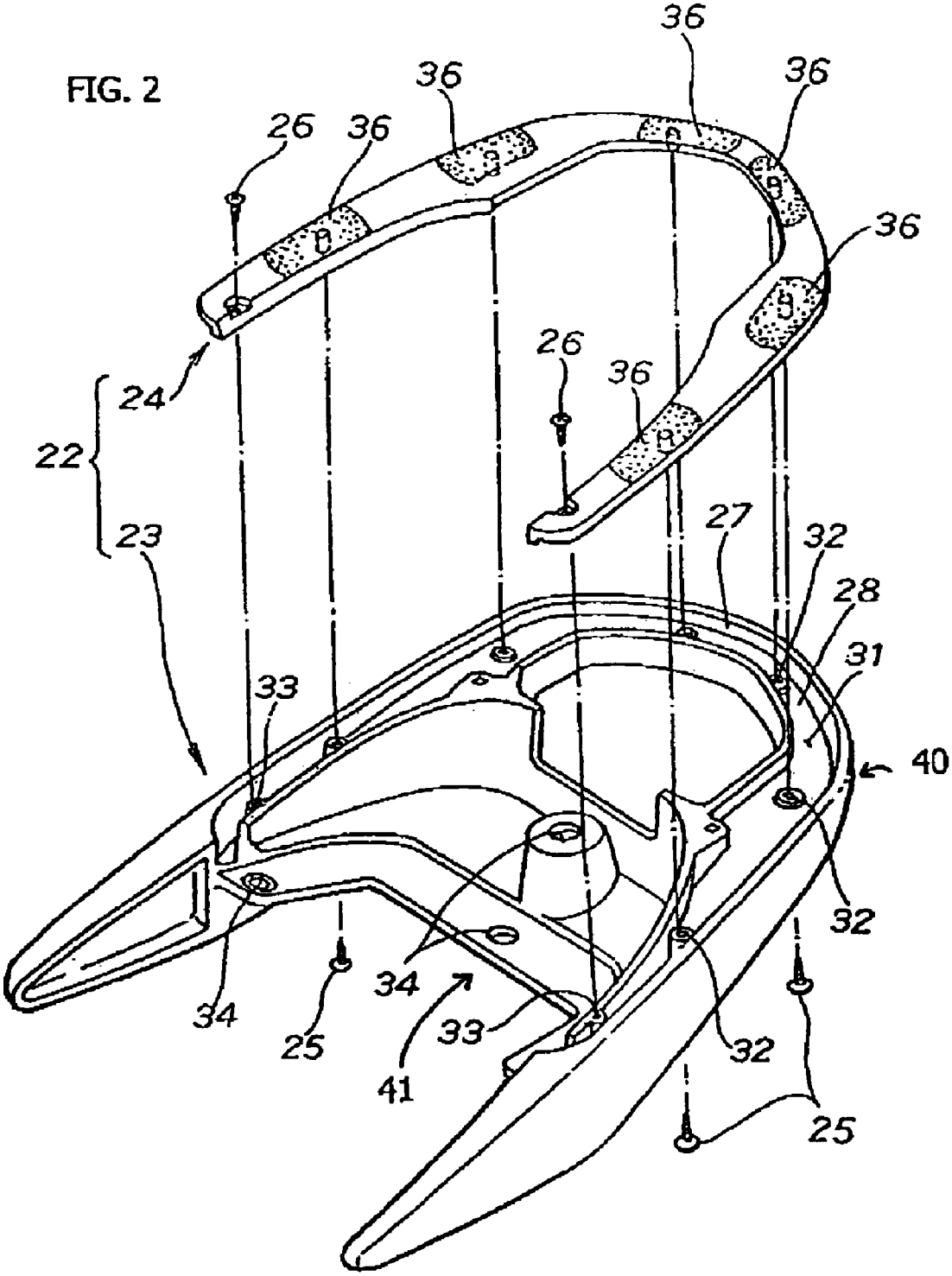
FIG. 2 is an exploded view of the rear grip apparatus according to selected embodiment of the present invention.

FIG. 2 is an exploded view of the rear grip apparatus according to the selected embodiment of the present invention. FIG. 2 shows the body member 23 of the rear grip apparatus 22, the grip face member 24 which fits nestingly into an opening formed in the top of the body member, and a plurality of screws 25 and 26, for securing the grip face member 24 and the body member 23 together.

In the depicted embodiment, the body member 23 is a molded article formed from a castable plastic or resin. The body member 23 has a generally U-shaped section or an H-shaped cross-sectional shape, including a sculpted recessed portion 28. The sculpted recessed portion 28 has an opening 27 formed in the top portion thereof, as shown.

The sculpted recessed portion 28 has a plurality of through holes 32 formed in a bottom 31 thereof for allowing the screws 25 to extend therethrough from below, and also has additional holes 33, 33 formed in the bottom 31 thereof, for receiving the screws 26, 26 screwed therein from above, as shown. Reference numerals 34 denote larger holes, for receiving attachment bolts (not shown) therethrough when the body member 23 is secured to the deck side.

The grip face member 24 is a molded article made of a resin and molded in the form of a cover, so that it can be fitted into the opening 27 in the sculpted recessed portion 28 of the body member 23 from above. As noted, the grip face member fits nestingly inside the opening 27 of the body member.

Further, the grip face member 24 may be injection molded, with non-slip textured irregularities 36 formed at portions thereof which are intended to be contacted by the palm of a user's hand when the user grabs the grip apparatus 10. The textured irregularities 36 provide purchase for a user's hand, may have any one of a variety of shapes or patterns, and may include fine detail work. The textured irregularities are preferred to be three-dimensional.

Figure 3:
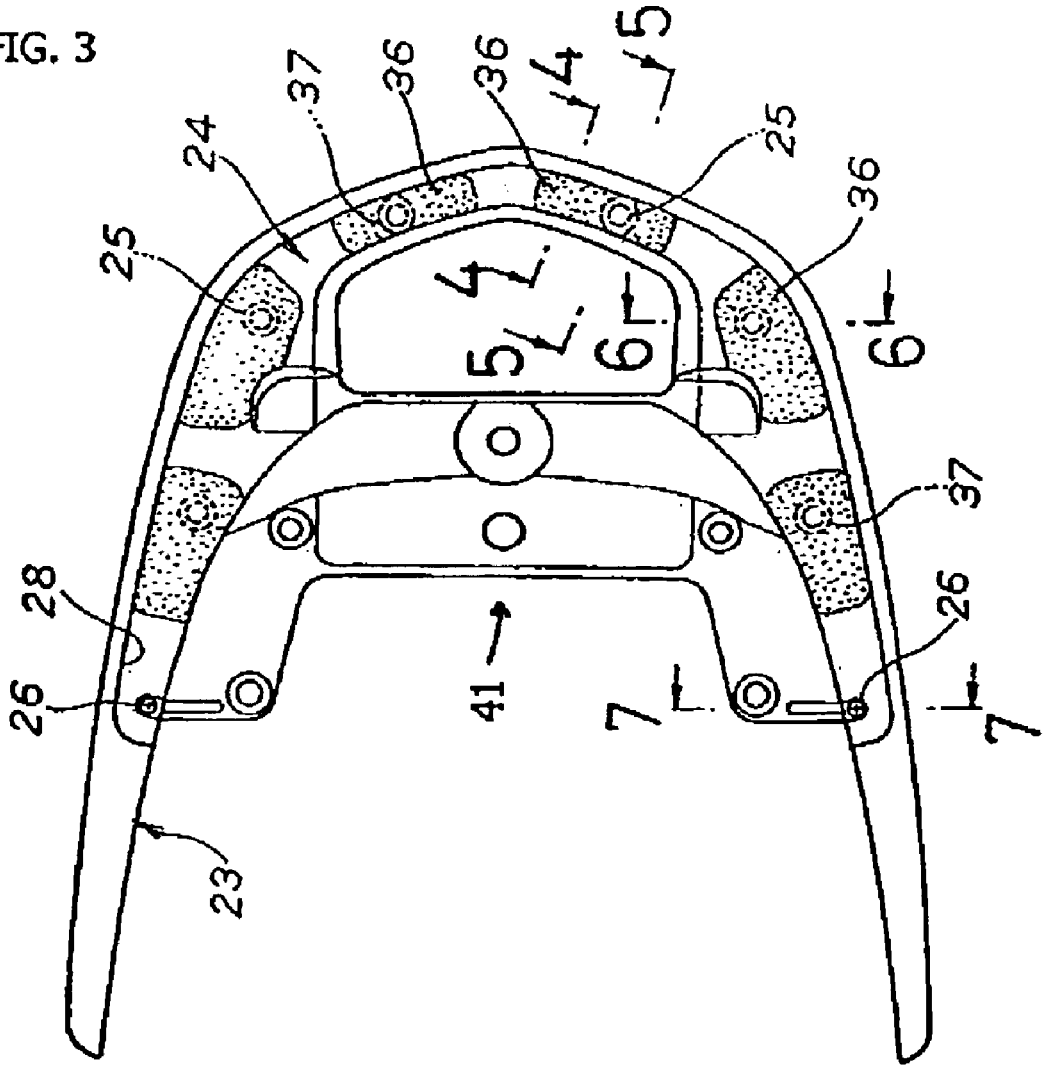
FIG. 3 is a top plan view of the rear grip apparatus according to the selected embodiment of the present invention.

FIG. 3 is a top plan view of the rear grip apparatus according to the selected embodiment of the present invention. FIG. 3 shows a state wherein the grip face member 24 is attached to the sculpted recessed portion 28 of the body member 23 by means of the screws 25 and 26, and shows that the non-slip textured irregularities 36 are formed on the surface of the grip face member 24.

Figure 5:
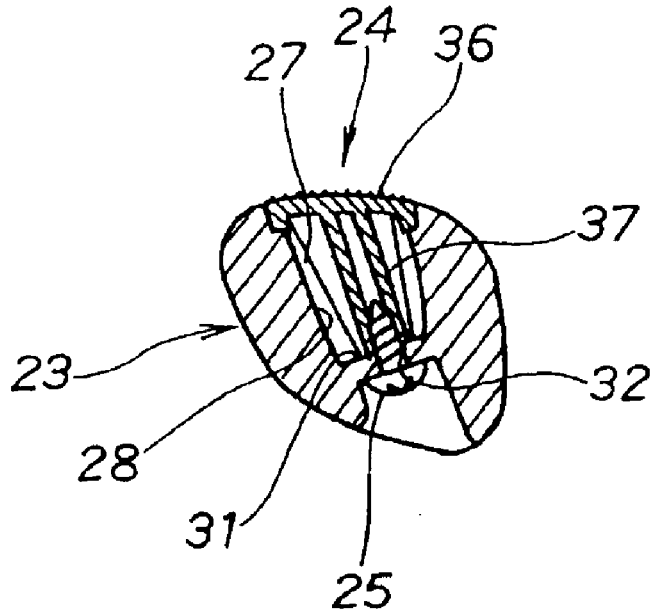
FIG. 5 is a sectional detail view taken along line 5—5 of FIG. 3.

A plurality of integral hollow tubular boss portions 37 are formed on the underside of the grip face member 24, to receive the screws 25 therein from below, as shown in FIGS. 3 and 5.

Figure 6:
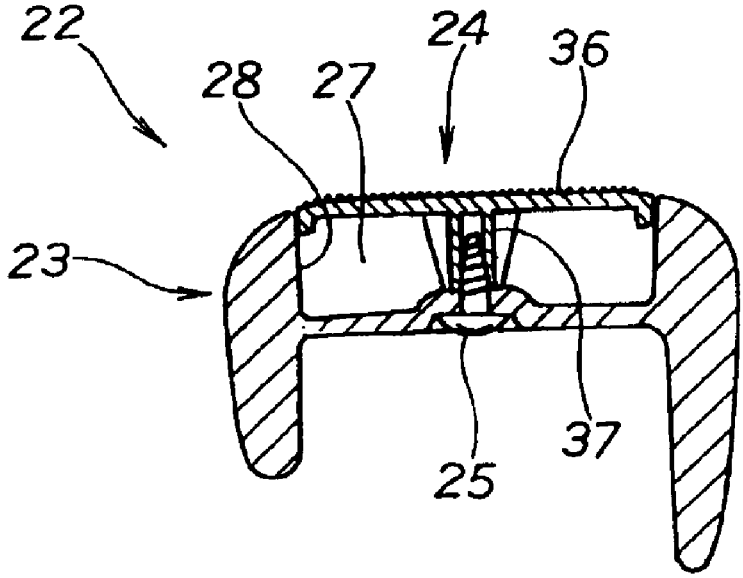
FIG. 6 is a sectional detail view taken along line 6—6 of FIG. 3.
Figure 7:
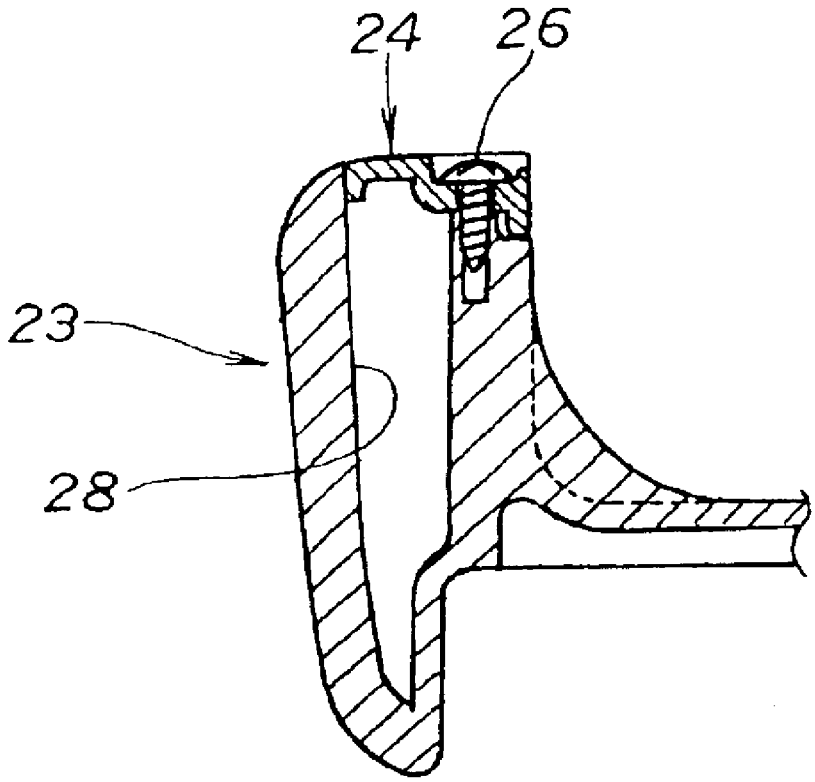
FIG. 7 is a sectional detail view taken along line 7—7 of FIG. 3.
Figure 8:
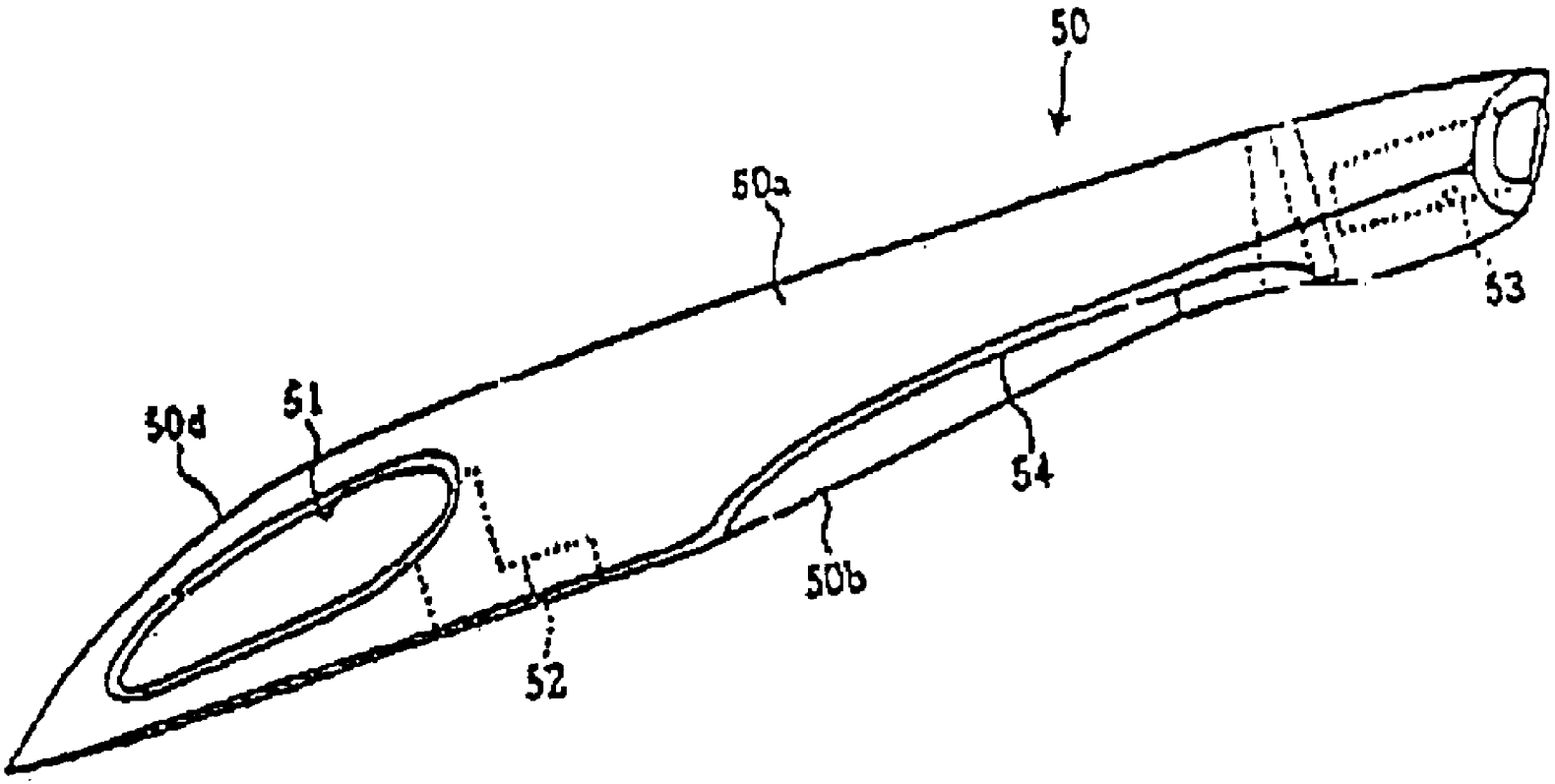
FIG. 8 PRIOR ART
FIG. 8 is a schematic view of a conventional prior art grab bar for a small watercraft.

A review of the drawings in FIGS. 5–7 will show that some of the screws 26 pass downwardly through selected holes in the grip face member and are embedded pointing downwardly in the body member, and other screws 25 pass upwardly through other selected holes 32 formed through the body member 23, and are embedded, pointing upwardly, in the tubular boss portions 37 of the grip face member 24.

FIG. 3 shows clearly that the body member 23 includes a generally inverted U-shaped rail portion 40 which has the sculpted recessed portion 28 therein, and a crossmember 41 connecting opposed legs of the rail portion 40, to form a generally A-shaped member. The crossmember 41 is provided to strengthen and reinforce the rail portion 40.

In contrast, the grip face member 24 is generally U-shaped, following the contours of the rail portion 40, as shown.

Figure 4:
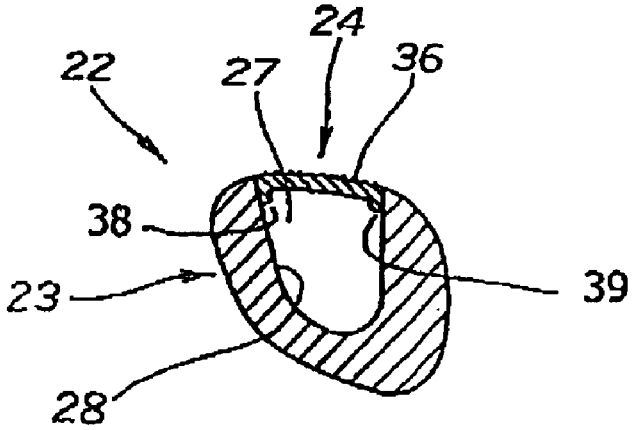
FIG. 4 is a sectional detail view taken along line 4—4 of FIG. 3.

FIG. 4 is a sectional detail view taken along line 4—4 of FIG. 3. FIG. 4 shows the body member 23 molded with a U-shaped cross-sectional shape, including the sculpted recessed portion 28, which has the opening 27 on the top thereof FIG. 4 also shows that the non-slip textured irregularities 36 are farmed at portions of the surface of the grip face member 24 intended for contact by the palm of a user's hand. The cross-sectional view of the grip face member 24 in FIG. 4 shows that it has integrally formed reinforcing ribs 38, 39 extending downwardly at opposite side edges thereof, to provide strength and reinforcement.

Since the rear grip apparatus 22 is configured such that the non-slip textured irregularities 36 are formed at portions of the grip face member 24 which the palm of the hand is intended to contact in this manner, the hand is less likely to slip on the grip face member 24, and may readily grasp the grip face member 24.

The locations of the grip face member 24 are so shaped that they have a U-shaped section and simultaneously have a groove width that tapers inwardly as it descends toward the bottom of the opening 27. Consequently, the surface of the grip face member 24 can be held in an off-set free state.

FIG. 5 is a sectional detail view taken along line 5—5 of FIG. 3. FIG. 5 shows that the body member 23 is molded with a substantially U-shaped cross-sectional shape, including the sculpted recessed portion 28 with has the opening 27 opening upwardly. The body member 23 also has the holes 32 formed in the bottom 31 thereof, for allowing the screws 25 to extend upwardly therethrough such that the grip face member 24 is secured by screwing the screws 25 into the boss portions 37 from below, as shown.

FIG. 6 is a sectional detail view taken along line 6—6 of FIG. 3. FIG. 6 shows the body member 23 molded with an H-shaped cross-sectional shape and including the sculpted recessed portion 28, which has the opening 27 opening upwardly, and the grip face member 24 is secured by means of the screws 25. Further, FIG. 6 shows that the non-slip textured irregularities 36 are formed at portions of the surface of the grip face member 24 which the palm of the hand is intended to contact.

Since the rear grip apparatus 22 includes the body member 23, grip face member 24, and screws 25 in this manner, molded articles according to the present invention may be molded from a resin by a molding method other than blow molding such as, for example, compression molding or injection molding. Accordingly, reduction of the production cost for a rear grip can be anticipated.

Further, since the grip face member 24 is an injection molded article and has the non-slip textured irregularities 36 formed at portions thereof to contact the palm of a user's hand, even where the textured irregularities 36 to be formed on the rear grip apparatus 22 have a fine detail configuration, the fine detail can be reliably and accurately transferred from the mold surface to the finished part due to the pressure applied during injection molding. Accordingly, fine detail work can be applied to the grip face member 24.

FIG. 7 is a sectional detail view taken along line 7—7 of FIG. 3. FIG. 7 shows the grip face member 24 provided in the form of a cover, which has been fitted on the sculpted recessed portion 28 of the body member 23 and secured to the body member 23 with a screw 26 extending downwardly through the grip face and into a hole 33 formed in the body member.

It is to be noted that the sculpted recessed portion 28 presented in the embodiment of the present invention may have any sectional shape.

Further, the interface where the body member 23 and the grip face member 24 contact one another may be positioned at any depth on the body member. The range of the non-slip textured irregularities 36 is not limited particularly.

According to one aspect of the invention, the rear grip for a personal watercraft includes a body member of a U-shaped section or an H-shaped section having a sculpted recessed portion opening upwardly, and a grip face member in the form of a cover for being fitted onto sculpted recess from above, and the body member and the grip face member are both molded articles of a resin. Therefore, the body member and the grip face member can be formed from molded articles molded by a molding method of a resin other than blow molding such as, for example, compression molding or injection molding. Accordingly, reduction of the production cost for a rear grip can be anticipated.

According to another aspect of the invention, the grip face member is an injection molded article and has non-slip textured irregularitirs formed at a portion thereof at which the palm of the band is to contact. Therefore, even if the configuration of the non-slip textured irregularities to be formed on the rear grip is set to a fine configuration, the fine configuration can be transferred from the mold surface of a metal mold by a pressure upon injection molding. Accordingly, desired fine working can be applied to the grip face member.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. In a personal watercraft of the type having a deck and a seat on the deck, the improvement comprising a rear grip apparatus provided on the watercraft behind the seat for being grasped by a passenger, said rear grip apparatus comprising:

a body member comprising a substantially U-shaped rail portion extending from an area proximate a left rear portion of the seat to an area proximate a right rear portion thereof, said body member having a U-shaped or an H-shaped cross section and comprising a sculpted recessed portion with an opening formed therein which faces upwardly; and a grip face member separate from said body member, said grip face member operatively attached to said body member and covering said sculpted recess thereof.

2. The rear grip apparatus of claim 1, wherein said grip face member fits nestingly into the opening of said sculpted recessed portion.

3. The rear grip apparatus of claim 1, wherein said grip face member is a product of an injection molding process.

4. The rear grip apparatus of claim 1, wherein said grip face member has slip-resistant textured irregularities formed on at least a portion thereof.

5. The rear grip apparatus of claim 1, wherein said grip face member comprises a center section and two integrally formed reinforcing ribs extending downwardly at opposite side edges of said center section.

6. The rear grip apparatus of claim 1, wherein said sculpted recessed portion of said body member has a tapered cross-sectional shape.

7. The rear grip apparatus of claim 1, wherein said body member further comprises a bridge portion connecting opposed legs of the rail portion and extending substantially horizontally therebetween to define a generally A-shaped member.

8. The rear grip apparatus of claim 1, wherein said grip face member has a plurality of substantially tubular integral bosses on the underside thereof to receive fasteners therein.

9. The rear grip apparatus of claim 1, wherein said grip face member has a plurality of holes formed therein to facilitate attachment to the body member.

10. In a personal watercraft of the type having a deck and a seat on the deck, the improvement comprising a rear grip apparatus provided on the watercraft behind the seat for being grasped by a passenger, said rear grip apparatus comprising:

a body member comprising a substantially U-shaped rail portion extending from an area proximate a left rear portion of the seat to an area proximate a right rear portion thereof, said rail portion comprising a sculpted recessed portion with an opening formed therein which faces upwardly; and a grip face member separate from said body member, said grip face member operatively attached to said body member and covering said sculpted recess thereof;

wherein said grip face member is a product of an injection molding process, and has slip-resistant textured irregularities formed on at least a portion thereof.

11. The rear pip apparatus of claim 10, wherein said grip face member comprises a center section and two integrally formed reinforcing ribs extending downwardly at opposite side edges of said center section.

12. The rear grip apparatus of claim 10, wherein said sculpted recessed portion of said body member has a tapered cross-sectional shape.

13. The rear grip apparatus of claim 10, wherein said body member further comprises a bridge portion connecting opposed legs of the rail portion and extending substantially horizontally therebetween to define a generally A-shaped member.

14. The rear grip apparatus of claim 10, wherein said grip face member has a plurality of substantially tubular integral bosses on the underside thereof, to receive fasteners therein.

15. The rear grip apparatus of claim 10, wherein said grip face member has a plurality of holes formed therein to facilitate attachment to the body member.

16. The rear grip apparatus of claim 10, wherein said grip face member fits nestingly into the opening of said sculpted recessed portion.

17. In a personal watercraft of the type having a deck and a seat on the deck, the improvement comprising a rear grip apparatus provided on the watercraft behind the seat for being grasped by a passenger, said rear grip apparatus comprising:

a body member comprising a sculpted recessed portion with an opening formed therein which faces upwardly; and a grip flies member separate from said body member for placement covering said sculpted recess thereof;

wherein said grip face member fits nestingly into the opening of said sculpted recessed portion;

wherein said body member comprises a generally U-shaped rail portion extending from an area proximate a left rear portion of the seat to an area proximate a right rear portion thereof, wherein said rail portion includes the sculpted recessed portion therein, and a bridge portion connecting opposed legs of the rail portion to define a generally A-shaped member;

and wherein said grip face member is a product of an injection molding process, and has slip-resistant textured irregularities formed on at least a portion thereof.

18. The rear grip apparatus of claim 17, wherein said grip face member comprises a center section and two integrally formed reinforcing ribs extending downwardly at opposite side edges of said center section.

19. The rear grip apparatus of claim 17, wherein said sculpted recessed portion of said body member has a tapered cross-sectional shape.

20. The rear grip apparatus of claim 1, wherein the grip face member extends about a rear portion of the seat, adjacent to a side edge thereof.

21. The rear grip apparatus of claim 17, wherein the grip face member extends about a rear portion of the seat, adjacent to a side edge thereof.

* * * * *

UNITED STATES PATENT AND TRADEMARK OFFICE

CERTIFICATE OF CORRECTION

PATENT NO. : 6,932,011 B2
DATED : August 23, 2005
INVENTOR(S) : Nagata et al.

It is certified that error appears in the above-identified patent and that said Letters Patent is hereby corrected as shown below:

Column 1,
Line 61, change "for a personal watercraft, wherein a seat is placed on a deck of the watercraft, and wherein a rear grip, which can be grasped by a passenger, is disposed rearwardly of the seat" to -- for a personal watercraft having a deck and a seat on the deck. The rear grip is provided for placement in back of the seat, to allow grasping thereof by a passenger --.

Column 3,
Line 41, change "with non-slip textured irregularities 36 formed" to -- with slip-resistant textured irregularities 36 formed --.
Line 53, change "the non-slip textured irregularities 36 are formed" to -- the slip-resistant textured irregularities 36 are formed --.

Column 4,
Line 20, change "non-slip textured irregularities are formed" to -- slip-resistant textured irregularities 36 are formed --.
Line 45, change "FIG 6 shows that the non-slip textured" to -- FIG. 6 shows that the slip-resistant textured --.
Line 57, change "the non-slip textured irregularities 36" to -- the slip-resistant textured irregularities 36 --.
Line 64, change "to the grip face member 24" to -- to the grip face member 24. The range of the slip-resistant textured irregularities 36 is not limited particularly. --.

Column 5,
Line 11, change "any depth on the body member. The range of the non-slip textured irregularities 16 is not limited particularly" to -- any depth on the body member --.

UNITED STATES PATENT AND TRADEMARK OFFICE

CERTIFICATE OF CORRECTION

PATENT NO. : 6,932,011 B2
DATED : August 23, 2005
INVENTOR(S) : Nagata et al.

It is certified that error appears in the above-identified patent and that said Letters Patent is hereby corrected as shown below:

Column 6,
Line 66, change “a grip flies member” to -- a grip face member --.

Signed and Sealed this

Twenty-first Day of February, 2006

JON W. DUDAS
*Director of the United States Patent and Trademark Office*

UNITED STATES PATENT AND TRADEMARK OFFICE

CERTIFICATE OF CORRECTION

PATENT NO. : 6,932,011 B2
APPLICATION NO. : 10/659719
DATED : August 23, 2005
INVENTOR(S) : Nagata et al.

It is certified that error appears in the above-identified patent and that said Letters Patent is hereby corrected as shown below:

Column 1,
Line 61, change "for a personal watercraft, wherein a seat is placed on a deck of the watercraft, and wherein a rear grip, which can be grasped by a passenger, is disposed rearwardly of the seat" to -- for a personal watercraft having a deck and a seat on the deck. The rear grip is provided for placement in back of the seat, to allow grasping thereof by a passenger --.

Column 3,
Line 41, change "with non-slip textured irregularities 36 formed" to -- with slip-resistant textured irregularities 36 formed --.
Line 53, change "the non-slip textured irregularities 36 are formed" to -- the slip-resistant textured irregularities 36 are formed --.

Column 4,
Line 20, change "non-slip textured irregularities are formed" to -- slip-resistant textured irregularities 36 are formed --.
Line 45, change "FIG 6 shows that the non-slip textured" to -- FIG. 6 shows that the slip-resistant textured --.
Line 57, change "the non-slip textured irregularities 36" to -- the slip-resistant textured irregularities 36 --.
Line 64, change "to the grip face member 24" to -- to the grip face member 24. The range of the slip-resistant textured irregularities 36 is not limited particularly. --.

Column 5,
Line 11, change "any depth on the body member. The range of the non-slip textured irregularities 36 is not limited particularly" to -- any depth on the body member --.

UNITED STATES PATENT AND TRADEMARK OFFICE

CERTIFICATE OF CORRECTION

PATENT NO. : 6,932,011 B2
APPLICATION NO. : 10/659719
DATED : August 23, 2005
INVENTOR(S) : Nagata et al.

It is certified that error appears in the above-identified patent and that said Letters Patent is hereby corrected as shown below:

Column 6,
Line 66, change "a grip flies member" to -- a grip face member --.

This certificate supersedes Certificate of Correction issued February 21, 2006.

Signed and Sealed this

Seventh Day of November, 2006

JON W. DUDAS
*Director of the United States Patent and Trademark Office*